US011965223B2

(12) United States Patent
Kohsaka et al.

(10) Patent No.: US 11,965,223 B2
(45) Date of Patent: Apr. 23, 2024

(54) THIN STEEL SHEET AND METHOD FOR MANUFACTURING THE SAME

(71) Applicant: JFE Steel Corporation, Tokyo (JP)

(72) Inventors: Noriaki Kohsaka, Tokyo (JP); Soshi Yoshimoto, Tokyo (JP); Tomohiro Hashimukai, Tokyo (JP); Takuya Hirashima, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 487 days.

(21) Appl. No.: 17/262,878

(22) PCT Filed: Jul. 18, 2019

(86) PCT No.: PCT/JP2019/028302
§ 371 (c)(1),
(2) Date: Jan. 25, 2021

(87) PCT Pub. No.: WO2020/026838
PCT Pub. Date: Feb. 6, 2020

(65) Prior Publication Data

US 2021/0310092 A1 Oct. 7, 2021

(30) Foreign Application Priority Data

Jul. 31, 2018 (JP) ..... 2018-143805

(51) Int. Cl.
*C21D 9/46* (2006.01)
*C21D 1/60* (2006.01)
(Continued)

(52) U.S. Cl.
CPC ..... *C21D 9/46* (2013.01); *C21D 1/60* (2013.01); *C21D 1/63* (2013.01); *C21D 6/004* (2013.01);
(Continued)

(58) Field of Classification Search
None
See application file for complete search history.

(56) References Cited

U.S. PATENT DOCUMENTS

2011/0005643 A1 1/2011 Murakami et al.
2015/0368742 A1 12/2015 Shibata et al.
(Continued)

FOREIGN PATENT DOCUMENTS

CN 101932745 A 12/2010
CN 102191363 A 9/2011
(Continued)

OTHER PUBLICATIONS

International Search Report and Written Opinion for International Application No. PCT/JP2019/028302, dated Oct. 21, 2019, 6 pages.
(Continued)

*Primary Examiner* — Anthony M Liang
(74) *Attorney, Agent, or Firm* — Buchanan Ingersoll & Rooney PC

(57) ABSTRACT

A thin steel sheet has a steel structure which has a ferrite area fraction of 30% or less, a bainite area fraction of 5% or less, a martensite and tempered martensite area fraction of 70% or more, and a retained austenite area fraction of 2.0% or less and in which the ratio of the dislocation density in the range of 0 μm to 20 μm from a surface of the steel sheet to the dislocation density of a through-thickness central portion of the steel sheet is 90% to 110% and the average of the top 10% of the sizes of cementite grains located in a depth of up to 100 μm from a surface of the steel sheet is 300 nm or less. The maximum camber of the steel sheet sheared to a length of 1 m in a longitudinal direction of the steel sheet is 15 mm or less.

4 Claims, 1 Drawing Sheet

(51) Int. Cl.

| | |
|---|---|
| ***C21D 1/63*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/42*** | (2006.01) |
| ***C22C 38/60*** | (2006.01) |

(52) U.S. Cl.

CPC ..... *C21D 6/005* (2013.01); *C21D 6/008* (2013.01); *C21D 8/0205* (2013.01); *C21D 8/0226* (2013.01); *C21D 8/0236* (2013.01); *C21D 8/0273* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/42* (2013.01); *C22C 38/60* (2013.01); *C21D 2211/001* (2013.01); *C21D 2211/002* (2013.01); *C21D 2211/005* (2013.01); *C21D 2211/008* (2013.01)

(56) References Cited

U.S. PATENT DOCUMENTS

| | | | |
|---|---|---|---|
| 2016/0369367 | A1 | 12/2016 | Shiraki et al. |
| 2017/0009315 | A1 | 1/2017 | Shibata et al. |
| 2017/0327926 | A1 | 11/2017 | Yoshimoto et al. |

FOREIGN PATENT DOCUMENTS

| | | | |
|---|---|---|---|
| CN | 104169445 | A | 11/2014 |
| CN | 105074040 | A | 11/2015 |
| CN | 105814227 | A | 7/2016 |
| CN | 107429362 | A | 12/2017 |
| EP | 2258887 | A1 | 12/2010 |
| EP | 2829618 | A1 | 1/2015 |
| EP | 2960353 | A1 | 12/2015 |
| EP | 3054025 | A1 | 8/2016 |
| EP | 3279353 | A1 | 2/2018 |
| JP | 08176884 | A | 7/1996 |
| JP | 2000160254 | A | 6/2000 |
| JP | 2009079255 | A | 4/2009 |
| WO | 2016107863 | A1 | 7/2015 |
| WO | 2015133550 | A1 | 9/2015 |
| WO | 2016084283 | A1 | 6/2016 |
| WO | 2018123356 | A1 | 7/2018 |

OTHER PUBLICATIONS

Zhongzhi et al., "Electrical Steel", Metallurgical Industry Press, 2012 with translation, 11 pages.

Yunkai, "Metal Material Science", Press of Beijing Institute of Technology, 2006 with translation, 8 pages.

Chinese Office Action for Chinese Application No. 201980050953.X, dated Aug. 20, 2021 with translation, 14 pages.

Extended European Search Report for European Application No. 19844217.0, dated Mar. 24, 2021, 10 pages.

Korean Office Action for Korean Application No. 10-2021-7002454, dated Jul. 14, 2022, with Concise Statement of Relevance of Office Action, 6 pages.

THIN STEEL SHEET AND METHOD FOR MANUFACTURING THE SAME

CROSS REFERENCE TO RELATED APPLICATIONS

This is the U.S. National Phase application of PCT/JP2019/028302, filed Jul. 18, 2019, which claims priority to Japanese Patent Application No. 2018-143805, filed Jul. 31, 2018, the disclosures of these applications being incorporated herein by reference in their entireties for all purposes.

FIELD OF THE INVENTION

The present invention relates to a thin steel sheet and a method for manufacturing the same. A thin steel sheet according to aspects of the present invention has a tensile strength (TS) of 980 MPa or more, good surface properties, a good steel sheet shape, and good fatigue strength. Therefore, the thin steel sheet according to aspects of the present invention is suitable as material for skeletal members for automobiles.

BACKGROUND OF THE INVENTION

In recent years, from the viewpoint of global environmental protection, improvements in automotive fuel efficiency have been directed in the whole automotive industry for the purpose of regulating $CO_2$ emissions. Automotive weight reduction by the gauge reduction of parts used is most effective in improving the fuel efficiency of automobiles. Therefore, in recent years, the consumption of high-strength steel sheets as materials for automotive parts has been increasing.

Martensite, which is a hard phase, is utilized in many steel sheets for the purpose of ensuring strength of the steel sheets. However, when martensite is formed, a sheet shape is deteriorated by transformation strain. Since the deterioration of the sheet shape adversely affects dimensional accuracy in forming, the sheet shape has been corrected by leveler processing or skin-pass rolling (temper rolling) such that desired dimensional accuracy is obtained. However, the leveler processing and the skin-pass rolling damage a sheet surface and deteriorate bending properties and delayed fracture resistance. Therefore, a high-strength steel sheet having excellent surface properties and a sheet shape is desired. In order not to deteriorate surface properties, it is necessary to suppress the deterioration of a sheet shape during a martensite transformation. Therefore, various techniques have been hitherto proposed.

For example, Patent Literature 1 describes that an ultra-high-strength cold-rolled steel sheet free from shape defects is obtained in such a manner that after a steel sheet is heated at the $A_{c1}$ transformation temperature to 900° C., the steel sheet is water-cooled or gas-water-cooled to a temperature range of (Ms+10° C.) to (Ms+100° C.) at an average cooling rate of 30° C./s to 500° C./s, is gas-cooled to a temperature range of (Ms−30° C.) to (Ms−100° C.), and is water-cooled or gas-water-cooled to 400° C. or lower at an average cooling rate of 30° C./s to 1,000° C./s, and the steel sheet in gas cooling is brought into contact with one or more pairs of rolls maintained at a temperature of (Ms+10° C.) to (Ms+100° C.). Incidentally, Ms represents the martensitic transformation start temperature, Ms point. In descriptions below, the Ms point is simply referred to as Ms in some cases.

Patent Literature 2 describes that a steel sheet with a good shape is obtained in such a manner that after a steel sheet is annealed at a temperature of the $A_{c1}$ transformation temperature of higher, the steel sheet is rapidly cooled from 650° C. to 750° C. at an average cooling rate of 400° C./s or more, is subsequently tempered by holding the steel sheet at a temperature of 100° C. to 450° C. for 100 sec to 1,200 sec and is then temper-rolled such that the average surface roughness Ra of the steel sheet becomes 1.4 μm or more.

PATENT LITERATURE

PTL 1: Japanese Unexamined Patent Application Publication No. 2000-160254

PTL 2: Japanese Unexamined Patent Application Publication No. 2009-79255

SUMMARY OF THE INVENTION

In a technique proposed in Patent Literature 1, although the steel sheet needs to be brought into contact with a heating roll for the purpose of eliminating temperature variations during gas cooling, bainite is inevitably formed because the cooling rate is significantly less than that of water cooling. If bainite is formed, then no desired steel sheet strength is obtained and strength variations are caused.

In a technique proposed in Patent Literature 2, a desired surface roughness Ra is obtained by transferring a rolling mill roll with a surface roughness Ra of 5.0 μm to 10.0 μm to a sheet surface. However, in this method, the rolling mill roll is a factor damaging a surface of a steel sheet and therefore a steel sheet with both good surface properties and a good steel sheet shape is not obtained.

In view of the fact that a steel sheet with both good surface properties and a good steel sheet shape is not obtained in either of the patent literatures, aspects of the present invention have an object to provide a thin steel sheet having a tensile strength (TS) of 980 MPa or more, good surface properties, a good steel sheet shape, and good fatigue strength and a method for manufacturing the same.

In order to solve the above problem, the inventors have intensively investigated requirements for thin steel sheets having a tensile strength (TS) of 980 MPa or more, good surface properties, a good steel sheet shape, and good fatigue strength. The thickness of a thin steel sheet intended in this matter is 0.4 mm to 2.6 mm. In general, increasing the strength of a steel sheet increases the concentration of an alloying element therein to adversely affect the spot weldability. Therefore, the inventors have focused on martensite, which is capable of efficiently obtaining strength in consideration of spot weldability. On the other hand, in order to efficiently obtain martensite without adding a large amount of an alloying concentration, it is effective to water-cool a steel sheet. However, a martensite transformation in water cooling occurs rapidly and heterogeneously and therefore deteriorates the shape of the steel sheet because of transformation strain. The inventors have investigated the reduction of a negative influence due to transformation strain and, as a result, have found that the shape of a sheet is improved by applying a binding force to the front and back surfaces of the sheet during the martensite transformation. In addition, it has become clear that when a sheet shape is good, excessive leveling is unnecessary and therefore workability and surface properties of a steel sheet are good.

Aspects of the present invention have been completed on the basis of the above finding and is as summarized below.

[1] A thin steel sheet has a component composition containing

C: 0.10% to 0.35%,
Si: 0.01% to 2.0%,
Mn: 0.8% to 2.35%,
P: 0.05% or less,
S: 0.005% or less,
Al: 0.005% to 0.10%, and
N: 0.0060% or less on a mass basis,
the balance being Fe and inevitable impurities, and a steel structure which has a ferrite area fraction of 30% or less (including 0%), a bainite area fraction of 5% or less (including 0%), a martensite and tempered martensite area fraction of 70% or more (including 100%), and a retained austenite area fraction of 2.0% or less (including 0%) and in which a ratio of a dislocation density in a range of 0 μm to 20 μm from a surface of the steel sheet to a dislocation density of a through-thickness central portion of the steel sheet is 90% to 110% and an average of a top 10% of sizes of cementite grains located in a depth of up to 100 μm from a surface of the steel sheet is 300 nm or less.

a maximum camber of the steel sheet sheared to a length of 1 m in a longitudinal direction of the steel sheet is 15 mm or less.

[2] In the thin steel sheet specified in Item [1], the component composition further contains one or two or more of V: 0.001% to 1%,
Ti: 0.001% to 0.3%,
Nb: 0.001% to 0.3%,
Cr: 0.001% to 1.0%,
Mo: 0.001% to 1.0%,
Ni: 0.01% to 1.0%,
Cu: 0.01% to 1.0%,
B: 0.0002% to 0.0050%,
Sb: 0.001% to 0.050%,
a REM: 0.0002% to 0.050%,
Mg: 0.0002% to 0.050%, and
Ca: 0.0002% to 0.050% on a mass basis.

[3] A method for manufacturing a thin steel sheet includes a hot-rolling step of hot-rolling steel having the component composition specified in Item [1] or [2];

a cold-rolling step of pickling and cold-rolling a steel sheet after the hot-rolling step; and an annealing step of heating the steel sheet after the cold-rolling step to 820° C. or higher in an atmosphere with a dew point of −25° C. or lower, starting water quenching at 700° C. or higher to water-cool the steel sheet to 100° C. or lower, and then reheating the steel sheet at 100° C. to 300° C.

The steel sheet in water cooling for the water quenching in the annealing step is pressed with two rolls placed to hold the steel sheet from the front and back surfaces of the steel sheet in a region that the surface temperature of the steel sheet is not lower than (Ms−250° C.) that is a temperature 250° C. lower than the Ms temperature nor higher than (Ms+150° C.) that is a temperature 150° C. higher than the Ms temperature, the pressing being performed under conditions that the inter-roll distance between the two rolls is 20 mm to 250 mm and the pressing force is 196 N or more.

In accordance with aspects of the present invention, a thin steel sheet according to aspects of the present invention has a tensile strength (TS) of 980 MPa or more, good surface properties, a good steel sheet shape, and good fatigue strength. Using the thin steel sheet according to aspects of the present invention to manufacture automotive parts allows the automotive parts to have further reduced weight.

DETAILED DESCRIPTION OF EMBODIMENTS OF THE INVENTION

Figure 1:
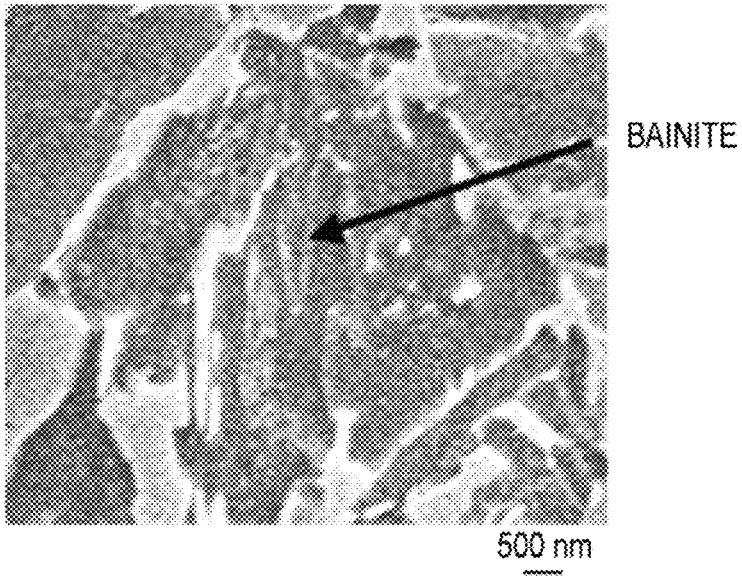
FIG. 1 is an illustration showing an example of bainite.

Embodiments of the present invention are described below. The present invention is not limited to the embodiments below.

A thin steel sheet according to aspects of the present invention is described in the order of the component composition and the configuration of a steel structure. In descriptions below, "%" used to express the content of a component refers to "mass percent".

C: 0.10% to 0.35%

C is an element that relates to the hardness of martensite and tempered martensite, which are main metallographic microstructures of steel according to aspects of the present invention, and that is necessary to improve the strength of steel sheets. In order to obtain a tensile strength of 980 MPa or more, the content of C needs to be at least 0.10% or more. The C content is preferably 0.11% or more. However, when the C content is greater than 0.35%, practical use is extremely difficult in terms of spot weldability and the like. Therefore, the C content is set to 0.35% or less. The C content is preferably 0.25% or less.

Si: 0.01% to 2.0%

Si is an element effective in improving the elongation of steel sheets. From the viewpoint of improving the elongation, the content of Si is set to 0.01% or more. The Si content is preferably 0.10% or more. However, when the Si content is greater than 2.0%, chemical convertibility is significantly degraded and steel sheets are unsuitable as automotive steel sheets. Therefore, the Si content is set to 2.0% or less. The Si content is preferably 1.7% or less.

Mn: 0.8% to 2.35%

Mn is an element which improves hardenability of steel sheets and which is effective in obtaining martensite. In order to suppress an area fraction of ferrite to 30% or less as required in accordance with aspects of the present invention, 0.8% or more Mn needs to be contained. The content of Mn is preferably 1.1% or more. However, containing an excess of Mn causes cracking due to the segregation of Mn in surfaces of steel sheets to deteriorate surface properties thereof. From the above, the Mn content is set to 2.35% or less. The Mn content is preferably 2.20% or less.

P: 0.05% or Less

P is a harmful element which causes low-temperature brittleness and which deteriorates weldability and therefore the content of P is preferably minimized. In accordance with aspects of the present invention, a P content of up to 0.05% is acceptable. The P content is preferably 0.02% or less. For use under severer welding conditions, the P content is more preferably suppressed to 0.01% or less. However, in terms of manufacture, 0.002% P is inevitably contained in some cases.

S: 0.005% or Less

S forms coarse sulfides in steel and these are elongated into wedge-shaped inclusions during hot rolling, whereby the weldability is adversely affected. Therefore, S is also a harmful element and the content of S is preferably minimized. In accordance with aspects of the present invention, an S content of up to 0.005% is acceptable and therefore the S content is set to 0.005% or less. The S content is preferably 0.003% or less. For use under severer welding conditions, the S content is more preferably suppressed to 0.001% or less. In terms of manufacture, 0.0002% or less of S is inevitably contained in some cases.

Al: 0.005% to 0.10%

Since Al is added at the stage of steelmaking as a deoxidizer, 0.005% or more Al needs to be contained. However, Al forms coarse oxides which deteriorate the weldability. Therefore, the content of Al is set to 0.10% or less. The Al content is preferably 0.010% to 0.08%.

N: 0.0060% or Less

N deteriorates the room-temperature aging resistance to cause unexpected cracking and therefore is a harmful element which adversely affects surface properties. Therefore, the content of N is preferably minimized. In accordance with aspects of the present invention, up to 0.0060% of N is acceptable. The N content is preferably 0.0050% or less. Although the N content is preferably minimized, 0.0005% or less N is inevitably contained in terms of manufacture in some cases.

The above are fundamental components in accordance with aspects of the present invention. In accordance with aspects of the present invention, the component composition may further contain one or two or more of V: 0.001% to 1%, Ti: 0.001% to 0.3%, Nb: 0.001% to 0.3%, Cr: 0.001% to 1.0%, Mo: 0.001% to 1.0%, Ni: 0.01% to 1.0%, Cu: 0.01% to 1.0%, B: 0.0002% to 0.0050%, Sb: 0.001% to 0.050%, a REM: 0.0002% to 0.050%, Mg: 0.0002% to 0.050%, and Ca: 0.0002% to 0.050% on a mass basis as arbitrary elements. V, Cr, Mo, and B are elements added from the viewpoint of ensuring the hardenability and the viewpoint of obtaining a sufficient martensite and tempered martensite area fraction. Ti and Nb are elements added from the viewpoint of adjusting the strength. Mg, the REM, and Ca are elements added from the viewpoint of controlling inclusions. Ni, Cu, and Sb are elements added from the viewpoint of enhancing the corrosion resistance. Even if these arbitrary elements are contained within the above ranges, effects according to aspects of the present invention are not deteriorated.

The balance other than the above components are Fe and inevitable impurities. Incidentally, when the above arbitrary components are contained at a level less than the lower limit, the arbitrary components, which are contained at a level less than the lower limit, are included in the inevitable impurities.

Subsequently, the steel structure of the thin steel sheet according to aspects of the present invention is described. The steel structure of the thin steel sheet according to aspects of the present invention has a ferrite area fraction of 30% or less (including 0%), a bainite area fraction of 5% or less (including 0%), a martensite and tempered martensite area fraction of 70% or more (including 100%), and a retained austenite area fraction of 2.0% or less (including 0%).

A Ferrite Area Fraction of 30% or Less (Including 0%)

Ferrite is soft. Therefore, when the area fraction thereof is greater than 30%, no desired steel sheet strength is obtained. Furthermore, the solid solubility of C in ferrite is low. Therefore, if an excess of ferrite is formed, then C concentrates in austenite during annealing, a shape correction effect by binding in water cooling described below is deteriorated because of Ms temperature variations unevenly due to a reduction in Ms temperature and C concentration, and no desired steel sheet shape is obtained. In accordance with aspects of the present invention, a ferrite area fraction of up to 30% is acceptable. The ferrite area fraction is preferably 20% or less. Even if the ferrite area fraction is 0%, an effect according to aspects of the present invention is not lost.

A Bainite Area Fraction of 5% or Less (Including 0%)

Forming bainite softens steel sheets and prevents uniform steel sheet strength from being obtained. Furthermore, the occurrence of bainite locally forms a hard phase. Therefore, a surface of a steel sheet is damaged during reverse bending in an annealing line, and no desired surface properties are obtained. Now, said reverse bending means bending in one direction and bending in the opposite direction repeatedly. From the above, the area fraction of bainite is preferably minimized and the upper limit thereof is set to 5%. The bainite area fraction is preferably 3% or less.

Incidentally, bainite, which is intended according to aspects the present invention, is a microstructure including bainitic ferrite that contains more dislocations than polygonal ferrite and tempered martensite and lower bainite, which cannot be identified with a scanning electron microscope, are not intended. Bainitic ferrite is ferrite having corrosion marks observed with a scanning electron microscope after being revealed by corrosion by 1% nital etching. A representative example thereof is shown in FIG. 1.

A Martensite and Tempered Martensite Area Fraction of 70% or More (Including 100%)

In accordance with aspects of the present invention, a desired strength is obtained with martensite and martensite which is tempered (tempered martensite). In order to obtain a tensile strength of 980 MPa or more, the above microstructures need to be 70% or more (including 100%) in total and are preferably 80% or more.

A Retained Austenite Area Fraction of 2.0% or Less (Including 0%)

In order to form more than 2.0% retained austenite, it is essential to produce the steel according to aspects of the present invention by a method other than bainite formation and water cooling. In accordance with aspects of the present invention, a manufacturing method other than the formation of bainite and water cooling is not intended and therefore the upper limit of the area fraction of retained austenite is set to 2.0%. Even if retained austenite is 0%, aspects of the present invention are not deteriorated.

Pearlite, cementite, and the like are cited as other microstructures other than ferrite, bainite, martensite, tempered martensite, and retained austenite. In accordance with aspects of the present invention, the occurrence of the microstructures represents insufficient annealing or insufficient cooling capacity. The area fraction of the microstructures is preferably 1% or less and more preferably 0%. Cementite is often contained in bainite and tempered martensite, which are not taken into account in calculating the area fraction of cementite. Cementite remaining in isolation in ferrite grains is not taken into account in calculating the area fraction. Since it is difficult to discriminate between cementite and martensite using a scanning electron microscope, cementite needs to be confirmed from a diffraction pattern obtained by an EBSD method or with a TEM. The area fraction of cementite remaining in isolation in ferrite grains is preferably 2% or less and more preferably 0%.

The ratio of the dislocation density in the range of 0 μm to 20 μm from a surface of the steel sheet to the dislocation density of a through-thickness central portion of the steel sheet being 90% to 110%

The steel according to aspects of the present invention obtains strength mainly by dislocation strengthening. When there are variations in dislocation density in a thickness direction of the steel sheet, fatigue strength and bending properties are affected. When the ratio of the dislocation density in the range of 0 μm to 20 μm from the steel sheet surface to the dislocation density of a through-thickness central portion of the steel sheet is less than 90%, the fatigue strength becomes low. On the other hand, when the above ratio is greater than 110%, bending properties are affected and, in particular, variations in bending properties are large. Therefore, the ratio of the dislocation density in the range of 0 μm to 20 μm from the steel sheet surface to the dislocation density of the through-thickness central portion of the steel sheet is set to 90% to 110% and is preferably 93% to 107%.

The average of the top 10% of the sizes of cementite grains located in a depth of up to 100 μm from a surface of the steel sheet: 300 nm or less Coarse cementite adversely affects bending properties. In order to obtain bending properties required in accordance with aspects of the present invention, the content of coarse cementite needs to be minimized and the average of the top 10% of the sizes of cementite grains needs to be 300 nm or less and is preferably 200 nm or less. Herein, the top 10% of the sizes of cementite grains targets those, having a large grain size, within the top 10% with respect to the number of all measurements when the measured cementite grains are arranged in increasing order of size. Incidentally, the grain size means the equivalent circle diameter.

Next, properties according to aspects of the present invention are described.

The thin steel sheet according to aspects of the present invention has high strength. In particular, the tensile strength (TS) measured by a method specified in an example is 980 MPa or more. The upper limit of the TS is not particularly limited and is preferably 2,500 MPa or less in view of the balance of other properties.

The thin steel sheet according to aspects of the present invention has good surface properties. Such good surface properties are evaluated with bending properties as specified in an example. In the thin steel sheet according to aspects of the present invention, Rmax−Rave is 0.8 mm or less as measured by a method specified in an example and is preferably 0.7 mm or less and more preferably 0.6 mm or less.

The thin steel sheet according to aspects of the present invention has a good sheet shape. Such a good sheet shape is evaluated by the maximum camber specified in an example. The maximum camber of the thin steel sheet, according to aspects of the present invention, sheared to a length of 1 m in a longitudinal direction of the steel sheet is 15 mm or less.

The thin steel sheet according to aspects of the present invention is excellent in fatigue properties. In particular, the fatigue strength ratio measured by a method specified in an example is 0.65 or more. The fatigue strength ratio is preferably high in view of fatigue properties and the upper limit of the fatigue strength ratio that is substantially obtained is 0.80 or less.

Next, a method for manufacturing the thin steel sheet according to aspects of the present invention is described. The method for manufacturing the thin steel sheet according to aspects of the present invention is a method for manufacturing a thin steel sheet having the above component composition and includes a hot-rolling step, a cold-rolling step and an annealing step. Incidentally, the temperature to or at which a slab (steel material) below, a steel sheet, or the like is heated or cooled means the surface temperature of the slab (steel material), the steel sheet, or the like unless otherwise specified.

The hot-rolling step is a step of hot-rolling steel having the above component composition.

A production process for producing the steel is not particularly limited. A known production process such as an electric furnace or a converter can be used. Furthermore, secondary smelting may be performed in a vacuum degassing furnace. Thereafter, from productivity and quality issues, a slab (steel material) is preferably manufactured by a continuous casting process. Alternatively, the slab may be manufactured by a known casting process such as an ingot casting-blooming process or a thin slab-casting process.

In the hot-rolling step, hot-rolling conditions are not particularly limited and may be appropriately set.

The cold-rolling step is a step of pickling and cold-rolling a steel sheet after the hot-rolling step. Pickling conditions and cold-rolling conditions are not particularly limited and may be appropriately set.

In the annealing step, after the steel sheet after the cold-rolling step is heated to 820° C. or higher in an atmosphere with a dew point of −25° C. or lower, water quenching is started at 700° C. or higher, the steel sheet is water-cooled to 100° C. or lower, and the steel sheet is then reheated at 100° C. to 300° C. The steel sheet in water cooling for water quenching in the annealing step is pressed with two rolls placed to hold the steel sheet from the front and back surfaces of the steel sheet in a region that the surface temperature of the steel sheet is not lower than (Ms−250° C.) that is a temperature 250° C. lower than the Ms temperature nor higher than (Ms+150° C.) that is a temperature 150° C. higher than the Ms temperature. The pressing is performed under conditions that the inter-roll distance between the two rolls is 20 mm to 250 mm and the pressing force is 196 N or more. The annealing step is preferably performed in a continuous annealing line.

Heating to 820° C. or Higher in an Atmosphere with a Dew Point of −25° C. or Lower When the dew point is higher than −25° C., the component composition of a surface layer changes locally and no structure with high dislocation density is obtained. Thus, the dew point needs to be −25° C. or lower. The dew point is preferably −30° C. or lower. The lower limit of the dew point is not particularly limited and is preferably −80° C. or higher from the viewpoint of an industrially possible range. An object of heating is to eliminate ferrite to form austenite. In order to obtain a ferrite area fraction of 30% or less, the heating temperature needs to be 820° C. or higher. The heating temperature is preferably 830° C. or higher. When a large amount of a ferrite-stabilizing element such as Si is contained and the amount of an austenite-stabilizing element such as Mn is small, the heating temperature is more preferably 840° C. or higher. The upper limit of the heating temperature is not particularly limited. When the heating temperature is too high, the water quenching start temperature is also high, resulting in that the temperature of the steel sheet sandwiched in water cooling is high and no sufficient shape correctability is obtained. Therefore, the upper limit of the heating temperature is preferably 1,000° C. or lower.

Starting Water Quenching at 700° C. or Higher

After heating, water quenching is performed. The temperature at which water quenching is started needs to be 700° C. or higher. The reason for this is that when the quenching start temperature is lower than 700° C., ferrite, which has been eliminated by heating, is formed again and no desired steel structure or properties are obtained. Incidentally, the quenching start temperature is preferably high in view of the stability of properties of the steel sheet. In fact, quenching is often performed at a temperature about 10° C. lower than the annealing temperature.

Figure 2:
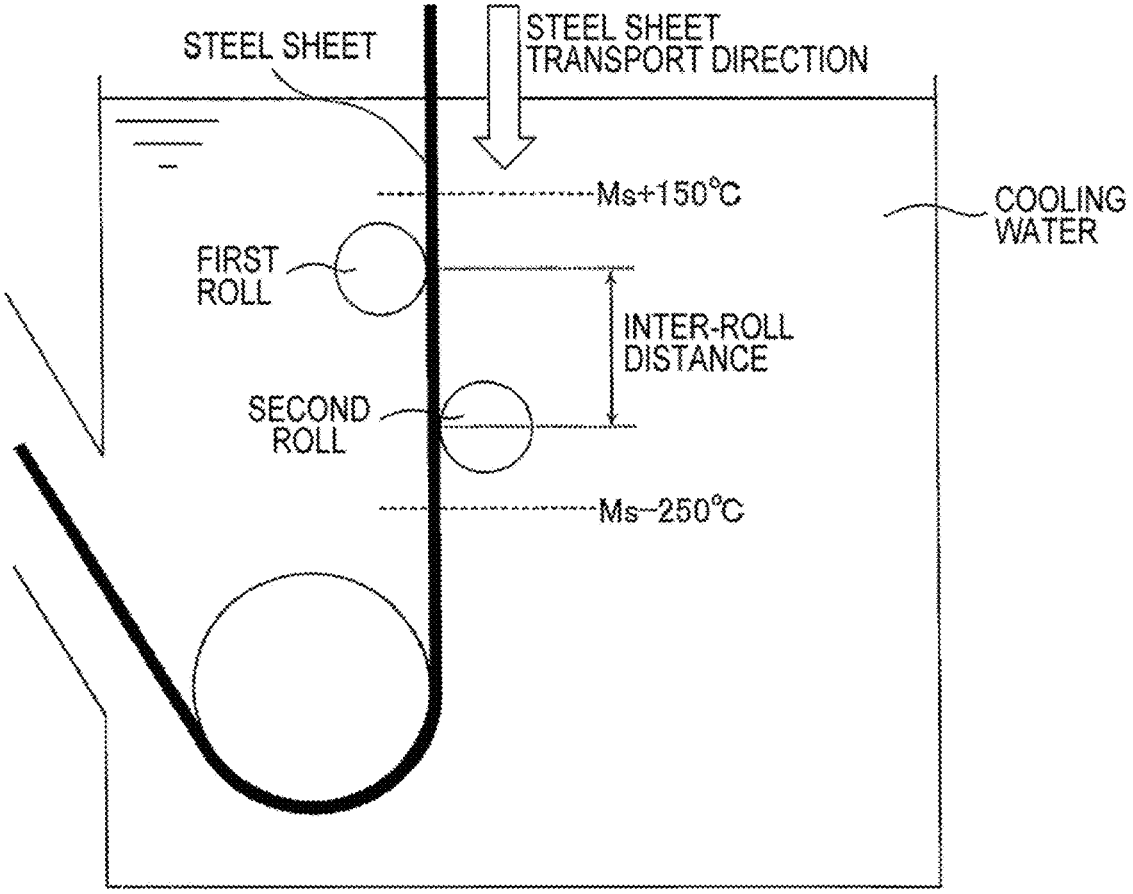
FIG. 2 is a schematic view illustrating the inter-roll distance between two rolls in water cooling for water quenching.

Pressing the steel sheet in water cooling for water quenching with two rolls placed to hold the steel sheet from the front and back surfaces of the steel sheet in a region that the surface temperature of the steel sheet is not lower than (Ms−250° C.) that is a temperature 250° C. lower than the Ms temperature nor higher than (Ms+150° C.) that is a temperature 150° C. higher than the Ms temperature The steel sheet in water cooling for the water quenching in the annealing step is pressed with the two rolls placed to hold the steel sheet from the front and back surfaces of the steel sheet in a region that the surface temperature of the steel sheet is not lower than (Ms−250° C.) that is a temperature 250° C. lower than the Ms temperature nor higher than (Ms+150° C.) that is a temperature 150° C. higher than the Ms temperature. In this operation, the inter-roll distance between the two rolls (hereinafter simply also referred to as the inter-roll distance) is 20 mm to 250 mm and the pressing force is 196 N or more. The term "inter-roll distance between two rolls" as used herein refers to the inter-contact distance between a contact point between one of the rolls and the steel sheet and a contact point between the other roll and the steel sheet as shown in FIG. 2.

Aspects of the present invention are characterized in that the shape of the steel sheet is improved by correcting transformation strain by binding in water cooling and excessive leveler straightening, which deteriorates surface properties, and straightening by skin-pass rolling are unnecessary. On the other hand, it has been difficult to practically bind a steel sheet in a martensite transformation which proceeds very quickly in water cooling. In order to solve this, it has been conceived to sandwich a steel sheet between rolls of which the positions are spaced. This has enabled the deterioration of a sheet shape to be effectively reduced even if a slight mismatch occurs between the martensite transformation temperature and the timing of binding. Since leveler processing, which is performed to correct the deterioration of a shape, and excessive skin-pass rolling are unnecessary, the increase in dislocation density of a surface structure can be suppressed and variations in bending properties can be reduced. In order to obtain this effect, the inter-roll distance (see FIG. 2) needs to be 20 mm or more. However, when the inter-roll distance is more than 250 mm, a binding effect by pressing is weak. Therefore, the inter-roll distance needs to be 250 mm or less. Binding is performed in such a manner that the steel sheet is pressed by sandwiching the steel sheet between the rolls, which are apart from each other. The pressing force necessary for shape correction is 196 N or more. This pressing force corresponds to the applied load of one roll. Preferred binding conditions include an inter-roll distance of 30 mm to 220 mm and a pressing force of 294 N to 4,900 N. The number of pairs of rolls may be one or more. When the temperature of the steel sheet is 100° C. or lower, a binding effect is small and therefore excessive addition provides a small effect. The pressing force varies depending on the strength or tension of the steel sheet. When the steel sheet is excessively pressed, that is, when each roll is located at a position that blocks the path of the steel sheet, the deterioration of a shape or surface properties is caused. Therefore, the indentation depth is preferably 10 mm or less and more preferably 5 mm or less. The pressing force can be adjusted with the tension, the indentation depth, or the like as described above. The fact that the pressing force is within the above range can be confirmed with a load indicator attached to the roll or the like. The indentation depth may be calculated from the diameter of the roll and the position of the roll.

The Ms temperature is determined by the steel composition and ferrite fraction of the steel sheet. In the scope of the present invention, the Ms temperature can be conveniently calculated by the following equation:

$$\text{Ms point [° C.]}=560-410\{([\%\ C]-2\times10^{-6}[\%\ V_F]^2)/(1-[\%\ V_F]/100)\}-7[\%\ Si]-38[\%\ Mn]-21[\%\ Cu]-20[\%\ Ni]-20[\%\ Cr]-5[\%\ Mo] \quad (1)$$

where [% M] (M=C, Si, Mn, Cu, Ni, Cr, or Mo) is the content (mass percent) of an alloying element contained in steel and [% $V_F$] is the area fraction (unit: %) of ferrite.

In order to bind the steel sheet in the martensite transformation, the binding start temperature needs to be not lower than the temperature (Ms−250° C.) that is 250° C. lower than the Ms point nor higher than the temperature (Ms+150° C.) that is 150° C. higher than the Ms point. The binding start temperature is preferably not lower than the temperature (Ms−200° C.) that is 200° C. lower than the Ms point nor higher than the temperature (Ms+100° C.) that is 100° C. higher than the Ms point. When the Ms point is lower than 300° C., the effect of correcting the shape of the steel sheet is weak. Therefore, the Ms point is preferably 300° C. or higher. From the viewpoint of ensuring the hardenability of the steel sheet, the upper limit of the Ms point is preferably 500° C. or lower and more preferably 480° C. or lower.

Water Cooling to 100° C. or Lower

When the temperature after water cooling is higher than 100° C., the martensite transformation proceeds after water cooling to adversely affect the shape thereof. Therefore, the temperature of the steel sheet after exiting from a water tank needs to be 100° C. or lower and is preferably 80° C. or lower.

Reheating at 100° C. to 300° C.

After water cooling, reheating needs to be performed to enhance the ductility by tempering martensite formed during water cooling such that forming for automobiles is possible. When the reheating temperature is lower than 100° C., necessary ductility is not obtained. Therefore, the reheating temperature is set to 100° C. or higher. The reheating temperature is preferably 130° C. or higher. However, if tempering is performed at higher than 300° C., cementite precipitated in martensite becomes coarse to deteriorate surface properties. From the above, the reheating temperature is set to 300° C. or lower. The reheating temperature is preferably 260° C. or lower.

Examples

Each of 250 mm thick steel materials having a component composition shown in Table 1 was hot-rolled at a finish rolling temperature of 860° C. to 930° C., followed by coiling at a coiling temperature of 480° C. to 580° C., whereby a hot-rolled sheet was obtained. After being pickled, the hot-rolled sheet was subjected to a cold-rolling step at a cold rolling reduction of 25% to 75%, whereby a cold-rolled sheet was obtained. The cold-rolled sheet was annealed in a continuous annealing line under conditions shown in Table 2, whereby a steel sheet used for evaluation was manufactured. When the cold rolling reduction was 25%, the sheet thickness was 2.4 mm. When the cold rolling reduction was 75%, the sheet thickness was 0.8 mm. Incidentally, when the temperature of a water-cooled steel sheet was higher than 100° C., the water-cooled steel sheet was air-cooled to 100° C. or lower.

The obtained steel sheets were evaluated by a technique below. For the difference between the maximum temperature at the passage of a binding roll and the Ms point, the temperature (° C.) at the passage of the binding roll was calculated by Equation (2) and the Ms point was calculated by Equation (1). As shown in FIG. 2, a first roll and a second roll were arranged in that order from the side close to the surface of water.

$$\text{Temperature at passage of binding roll (° C.)}=(1634/d-119)t \quad (2)$$

where d is the sheet thickness (mm) and t is the time (s) from the start of water cooling to the first passage of a binding roll. Equation (2) is applicable when the temperature of water in a water tank is 50° C. or lower. A change in water temperature causes a difference between a calculated value and the actual temperature of a sheet and, however, does not affect steel sheet properties when the water temperature is 50° C. or lower. However, it is preferable that the temperature corresponding to an actual line is measured or correction is performed by a heat-transfer calculation.

Each steel sheet was pressed between the first roll and the second roll with a pressing force shown in Table 2 in such a manner that the steel sheet was pressed with the two rolls from the front and back surfaces thereof.

After annealing, skin-pass rolling or leveler straightening was not performed twice or more but only usual skin-pass rolling with an elongation of 0.2% was performed, followed by evaluation.

(i) Microstructure Observation (Area Fraction of Steel Structure)

A specimen was cut from each steel sheet such that a through-thickness cross section parallel to a rolling direction was an observation surface. A through-thickness central portion (a through-thickness central portion including the observation surface) was revealed by corrosion using 1 volume percent nital. A through-thickness ¼t portion was photographed for ten fields of view at 2,000× magnification using a scanning electron microscope. Ferrite is a microstructure in which no corrosion mark is observed in a grain. Tempered martensite is a microstructure in which a large number of fine cementites having orientations in a grain and a size of 500 nm or less and corrosion marks are observed in a grain. Martensite is a microstructure which is observed with a whiter contrast than ferrite and in which the precipitation of cementite is not observed in a grain. Since retained austenite and martensite are observed in the same morphology, a value obtained by subtracting the retained austenite fraction determined by XRD below from the martensite area determined with a scanning electron microscope was counted as the area fraction of martensite. A bainite microstructure targeted bainitic ferrite having corrosion marks. The area fraction of each of the above microstructures was determined by an intercept method in which 20 horizontal lines with an actual length of 30 μm and 20 vertical lines with an actual length of 30 μm were drawn on an obtained photograph so as to form a grid pattern, a microstructure at each intersection point was identified, and the ratio of the number of intersection points of the microstructure to the number of all intersection points was defined as the area fraction of the microstructure.

The size of cementite grains in a depth of up to 100 μm from a surface of the steel sheet was measured in such a manner that a thin film was prepared in a depth of up to 100 μm by a twin-jet method and was observed at an accelerating voltage of 200 kV using a transmission electron microscope (TEM). Two hundred or more cementite grains were observed. The average of the sizes of cementite grains in the top 10% was shown in Table 3. Cementite may be identified using an EDS attached to the TEM, a diffraction pattern, or the like.

(ii) Measurement of Retained Austenite Fraction by XRD

After the steel sheet was polished to a through-thickness one-fourth position, a surface further polished by 0.1 mm by chemical polishing was measured for the integrated reflection intensity of the (200) plane, (220) plane, and (311) plane of fcc iron (austenite) and the (200) plane, (211) plane, and (220) plane of bcc iron (ferrite) with X-ray diffractometer using a Mo Kα radiation. The percentage of austenite that was determined from the ratio of the integrated reflection intensity of each plane of fcc iron (austenite) to the integrated reflection intensity of each plane of bcc iron (ferrite) was defined as the fraction of retained austenite. The retained austenite fraction was regarded as the area fraction of retained austenite in accordance with aspects of the present invention.

(iii) Tensile Test

JIS No. 5 tensile specimens were prepared from each obtained steel sheet in a direction perpendicular to the rolling direction and were subjected to a tensile test in accordance with standards of JIS Z 2241 (2011) five times, whereby the average yield strength (YS), tensile strength (TS), and total elongation (El) were determined. The cross head speed in the tensile test was set to 10 mm/min. In Table 3, a tensile strength of 980 MPa or more was defined as a mechanical property of a steel sheet required in accordance with aspects of the present invention steel.

(iv) Evaluation of Bending Properties

Forming members are unacceptable because of the cracking of bent portions in some cases. This is due to the local deterioration of bending properties and often results from cracks in steel sheet surfaces. Such cracks in steel sheet surfaces are caused when steel sheets with a poor shape are subjected to skin-pass rolling or leveler processing two or more times. In accordance with aspects of the present invention, shape correction which causes the local deterioration of bending properties is unnecessary and therefore the local deterioration of bending properties can be suppressed. In order to evaluate bending properties, after 50 strip-shaped samples with a width of 100 mm and a length of 40 mm were cut from a lateral central portion and sheared end surfaces thereof were ground, samples for bending evaluation by a 90° V-bending test (a bending ridge line extending in the rolling direction) by a V-block method in accordance with standards of JIS Z 2248 (1996) were prepared. The vicinity of the bend top was observed with an optical microscope with 20× magnification or a loupe, whereby the presence or absence of a crack was determined. The average (Rave) of the minimum bend radii of press dies causing no cracks and the maximum (Rmax) of the minimum bend radii of the 50 evaluated samples were shown in Table 3. A level of Rmax−Rave=0.8 mm or less was a preferable range in accordance with aspects of the present invention and surface properties were rated good.

(v) Fatigue Test

A No. 1 tensile specimen, having a width of 15 mm, in accordance with JIS Z 2275 was taken from each obtained steel sheet in a direction perpendicular to the rolling direction and was subjected to a fatigue test in accordance with JIS Z 2273 using a plane bending fatigue testing machine. The stress amplitude causing no fracture by stressing $10^7$ times under conditions where the stress ratio was −1, the frequency was 20 Hz, and the maximum number of cycles was $10^7$ was determined and was divided by the tensile strength, whereby the fatigue strength ratio was determined. The fatigue strength ratio required in accordance with aspects of the present invention was set to 0.65 or more.

(vi) Evaluation of Steel Sheet Shape

Each of cold-rolled steel sheets not laterally sheared was longitudinally sheared into a steel sheet with a length of 1 m in a steel sheet longitudinal direction (steel sheet transport direction), the steel sheet was put on a horizontal base, and the maximum height of the steel sheet from the base was measured as the "maximum camber". The results were shown in Table 3. The fact that the maximum camber of a steel sheet sheared to a length of 1 m in the steel sheet longitudinal direction (steel sheet transport direction) was 15 mm was defined as a steel sheet shape required in accordance with aspects of the present invention.

(vii) Dislocation Density

For each steel sheet, the ratio of the dislocation density in the range of 0 μm to 20 μm from a surface of the steel sheet was measured by a method below.

The steel sheet surface was polished such that scales were removed, followed by measuring the steel sheet surface by X-ray diffraction. Herein, the depth of polishing for scale removal was less than 1 μm. A radiation source was Co. Since the depth of analysis of Co is about 20 μm, using Co as a radiation source enables the dislocation density in the range of 0 μm to 20 μm from the steel sheet surface to be measured. A technique in which the density of dislocations was converted from the strain determined from the half-value breadth β in X-ray diffraction measurement was used. The Williamsson-Hall method below is used to extract the strain. The spread of the half-value breadth is affected by the size D of a crystallite and the strain ε and can be calculated as the sum of both factors by the following equation: $\beta=\beta1+\beta2=(0.9\lambda/(D\times\cos\theta))+2\varepsilon\times\tan\theta$. Furthermore, this equation is modified into $\beta\cos\theta/\lambda=0.9\lambda/D+2\otimes\times\sin\theta/\lambda$. The strain ε is calculated from the slope of a straight line by plotting $\beta\cos\theta/\lambda$ against $\sin\theta/\lambda$. Incidentally, diffraction lines used for calculation are (110), (211), and (220). For the conversion of the density of dislocations from the strain ε, $\rho=14.4\varepsilon^2/b^2$ was used. Incidentally, θ represents the peak angle calculated by the θ-2θ method of X-ray diffraction, λ represents the wavelength of an X-ray used for X-ray diffraction, and b represents the Burgers vector of Fe(α) and was 0.25 nm in this example.

Furthermore, the dislocation density of a through-thickness central portion was measured in the range of 0 μm to 20 μm from a through-thickness central position. This measurement method was the same as the above method for measurement in the range of 0 μm to 20 μm from the steel sheet surface except a measurement position. The dislocation density in the range of 0 μm to 20 μm from the through-thickness central position was measured as described above and was defined as the dislocation density of the through-thickness central portion.

The ratio (%) of the dislocation density in the range of 0 μm to 20 μm from the steel sheet surface to the dislocation density of the through-thickness central portion was determined.

<Evaluation Results>

All steel sheets of inventive examples had a tensile strength (TS) of 980 MPa or more, good surface properties, a good steel sheet shape, and good fatigue strength. However, steel sheets of comparative examples that were outside the scope of the present invention did not satisfy any of these.

In particular, in Steel Sheet No. 3 in Table 2, the temperature at the passage of a first roll was not Ms+150° C. or lower, and therefore hardening during cooling in water quenching was insufficient. Therefore, as shown in Table 3, no desired steel structure was not obtained and the tensile strength was less than 980 MPa.

TABLE 1

| Steel | Chemical composition (mass percent) | | | | | | | | |
|---|---|---|---|---|---|---|---|---|---|
| No. | C | Si | Mn | P | S | Al | N | Others | Remarks |
| A | 0.11 | 1.40 | 2.18 | 0.006 | 0.0007 | 0.03 | 0.0040 | — | Appropriate steel |
| B | 0.13 | 1.45 | 2.07 | 0.011 | 0.0009 | 0.02 | 0.0031 | — | Appropriate steel |
| C | 0.15 | 0.60 | 1.62 | 0.008 | 0.0004 | 0.02 | 0.0031 | — | Appropriate steel |
| D | 0.14 | 1.50 | 1.21 | 0.006 | 0.0007 | 0.02 | 0.0025 | — | Appropriate steel |
| E | 0.20 | 0.18 | 1.14 | 0.014 | 0.0009 | 0.04 | 0.0031 | — | Appropriate steel |
| F | 0.25 | 0.45 | 1.10 | 0.015 | 0.0012 | 0.06 | 0.0043 | Cu: 0.12<br>Ni: 0.03<br>Cr: 0.03<br>Sb: 0.008 | Appropriate steel |
| G | 0.31 | 0.73 | 1.29 | 0.010 | 0.0011 | 0.03 | 0.0040 | Ti: 0.02<br>Nb: 0.02<br>B: 0.002<br>Ca: 0.001<br>REM: 0.002 | Appropriate steel |
| H | 0.15 | 0.23 | 1.45 | 0.009 | 0.0011 | 0.02 | 0.0042 | Mg: 0.001<br>Mo: 0.02<br>V: 0.05 | Appropriate steel |
| I | 0.14 | 0.08 | 1.60 | 0.009 | 0.0011 | 0.02 | 0.0042 | — | Appropriate steel |
| J | 0.16 | 1.80 | 1.50 | 0.009 | 0.0011 | 0.03 | 0.0042 | — | Appropriate steel |
| K | 0.12 | 0.60 | 2.25 | 0.012 | 0.0010 | 0.03 | 0.0039 | — | Appropriate steel |
| L | 0.14 | 1.50 | 1.21 | 0.030 | 0.0007 | 0.02 | 0.0025 | — | Appropriate steel |
| M | 0.25 | 0.45 | 1.00 | 0.015 | 0.0012 | 0.06 | 0.0043 | — | Appropriate steel |

TABLE 1-continued

| Steel No. | Chemical composition (mass percent) C | Si | Mn | P | S | Al | N | Others | Remarks |
|---|---|---|---|---|---|---|---|---|---|
| N | 0.08 | 0.20 | 1.31 | 0.009 | 0.0013 | 0.04 | 0.0045 | — | Comparative steel |
| O | 0.17 | 0.23 | 0.43 | 0.014 | 0.0009 | 0.04 | 0.0041 | — | Comparative steel |
| P | 0.21 | 1.06 | 2.86 | 0.012 | 0.0009 | 0.03 | 0.0028 | — | Comparative steel |

TABLE 2

| Steel sheet No. | Steel No. | Dew point (° C.) | Heating temperature (° C.) | Water-cooling start temperature (° C.) | Ms + 150 (° C.) | Temperature at passage of first roll (° C.) | Temperature at passage of second roll (° C.) |
|---|---|---|---|---|---|---|---|
| 1 | A | −32 | 858 | 763 | 578 | 394 | 249 |
| 2 | | −33 | 857 | 412 | 443 | 298 | 201 |
| 3 | | −34 | 855 | 741 | 558 | 602 | 435 |
| 4 | | −34 | 836 | 738 | 581 | 322 | 167 |
| 5 | | −36 | 855 | 759 | 581 | 456 | 462 |
| 6 | | −35 | 841 | 748 | 579 | 563 | 183 |
| 7 | | −36 | 843 | 740 | 580 | 457 | 323 |
| 8 | | −37 | 840 | 761 | 572 | 404 | 198 |
| 9 | | −42 | 845 | 736 | 572 | 409 | 261 |
| 10 | | −15 | 859 | 751 | 572 | 433 | 209 |
| 11 | B | −34 | 855 | 732 | 566 | 407 | 260 |
| 12 | | −35 | 825 | 730 | 551 | 400 | 250 |
| 13 | | −38 | 855 | 735 | 558 | 400 | 260 |
| 14 | | −34 | 840 | 732 | 558 | 410 | 230 |
| 15 | | −34 | 845 | 730 | 557 | 410 | 260 |
| 16 | C | −40 | 833 | 757 | 573 | 416 | 209 |
| 17 | D | −39 | 840 | 757 | 605 | 427 | 276 |
| 18 | E | −39 | 846 | 765 | 573 | 398 | 205 |
| 19 | F | −42 | 845 | 756 | 559 | 388 | 273 |
| 20 | G | −39 | 833 | 763 | 533 | 378 | 195 |
| 21 | H | −38 | 844 | 764 | 593 | 419 | 300 |
| 22 | I | −40 | 850 | 770 | 592 | 419 | 250 |
| 23 | J | −40 | 850 | 760 | 576 | 425 | 260 |
| 24 | K | −40 | 850 | 765 | 574 | 420 | 250 |
| 25 | L | −36 | 860 | 740 | 605 | 400 | 280 |
| 26 | M | −36 | 860 | 740 | 559 | 405 | 280 |
| 27 | | −37 | 860 | 720 | 559 | 405 | 300 |
| 28 | N | −39 | 839 | 765 | 626 | 505 | 339 |
| 29 | O | −42 | 865 | 732 | 609 | 433 | 210 |
| 30 | P | −32 | 849 | 761 | 447 | 288 | 231 |

| Steel sheet No. | Ms − 250 (° C.) | Inter-roll distance between two rolls (mm) | Pressing force (kgf) | Pressing force (N) | Temperature after water cooling (° C.) | Reheating temperature (° C.) | Remarks |
|---|---|---|---|---|---|---|---|
| 1 | 178 | 93 | 56 | 549 | 58 | 198 | Inventive example |
| 2 | 43 | 72 | 65 | 637 | 54 | 178 | Comparative example |
| 3 | 158 | 111 | 56 | 549 | 56 | 183 | Comparative example |
| 4 | 181 | 99 | 97 | 951 | 48 | 156 | Comparative example |
| 5 | 181 | 5 | 54 | 529 | 43 | 183 | Comparative example |
| 6 | 179 | 263 | 87 | 853 | 47 | 172 | Comparative example |
| 7 | 180 | 81 | 5 | 49 | 50 | 177 | Comparative example |
| 8 | 172 | 131 | 108 | 1058 | 243 | 168 | Comparative example |
| 9 | 172 | 95 | 88 | 862 | 44 | 315 | Comparative example |
| 10 | 172 | 143 | 95 | 931 | 42 | 150 | Comparative example |
| 11 | 166 | 96 | 97 | 951 | 50 | 169 | Inventive example |
| 12 | 151 | 100 | 80 | 784 | 50 | 170 | Inventive example |
| 13 | 158 | 25 | 100 | 980 | 45 | 175 | Inventive example |
| 14 | 158 | 240 | 60 | 588 | 50 | 180 | Inventive example |
| 15 | 157 | 80 | 25 | 245 | 40 | 170 | Inventive example |
| 16 | 173 | 150 | 107 | 1049 | 57 | 188 | Inventive example |
| 17 | 205 | 95 | 84 | 823 | 43 | 160 | Inventive example |
| 18 | 173 | 142 | 110 | 1078 | 58 | 157 | Inventive example |
| 19 | 159 | 78 | 80 | 784 | 46 | 161 | Inventive example |
| 20 | 133 | 113 | 75 | 735 | 46 | 178 | Inventive example |
| 21 | 193 | 86 | 105 | 1029 | 47 | 199 | Inventive example |
| 22 | 192 | 100 | 200 | 1960 | 40 | 180 | Inventive example |
| 23 | 176 | 110 | 200 | 1960 | 25 | 180 | Inventive example |

TABLE 2-continued

| | | | | | | | |
|---|---|---|---|---|---|---|---|
| 24 | 174 | 120 | 200 | 1960 | 35 | 180 | Inventive example |
| 25 | 205 | 120 | 22 | 216 | 25 | 200 | Inventive example |
| 26 | 159 | 150 | 22 | 216 | 25 | 150 | Inventive example |
| 27 | 159 | 100 | 22 | 216 | 25 | 280 | Inventive example |
| 28 | 226 | 116 | 106 | 1039 | 54 | 183 | Comparative example |
| 29 | 209 | 143 | 71 | 696 | 52 | 197 | Comparative example |
| 30 | 47 | 37 | 81 | 794 | 52 | 189 | Comparative example |

TABLE 3

| Steel sheet | Metal microstructure | | | | | | Mechanical properties of steel sheet Yield strength |
|---|---|---|---|---|---|---|---|
| No. | *1 (%) | *2 (%) | *3 (%) | *4 (%) | *5 (%) | *6 (nm) | (MPa) |
| 1 | 6 | 1 | 93 | 0 | 96 | 183 | 888 |
| 2 | 78 | 4 | 16 | 2 | 94 | 171 | 437 |
| 3 | 35 | 18 | 44 | 3 | 99 | 175 | 471 |
| 4 | 0 | 1 | 98 | 1 | 93 | 150 | 670 |
| 5 | 0 | 0 | 100 | 0 | 111 | 173 | 678 |
| 6 | 4 | 2 | 94 | 0 | 97 | 166 | 786 |
| 7 | 2 | 2 | 96 | 0 | 99 | 170 | 772 |
| 8 | 17 | 0 | 83 | 0 | 94 | 157 | 712 |
| 9 | 17 | 1 | 82 | 0 | 95 | 318 | 809 |
| 10 | 8 | 0 | 92 | 0 | 78 | 148 | 758 |
| 11 | 18 | 0 | 81 | 1 | 95 | 240 | 838 |
| 12 | 25 | 1 | 74 | 0 | 101 | 160 | 887 |
| 13 | 16 | 4 | 80 | 0 | 104 | 155 | 876 |
| 14 | 16 | 2 | 82 | 0 | 98 | 163 | 881 |
| 15 | 17 | 2 | 81 | 0 | 99 | 158 | 890 |
| 16 | 1 | 1 | 98 | 0 | 97 | 180 | 1166 |
| 17 | 12 | 1 | 87 | 0 | 93 | 153 | 1094 |
| 18 | 2 | 0 | 98 | 0 | 97 | 154 | 1303 |
| 19 | 0 | 1 | 98 | 1 | 93 | 157 | 1588 |
| 20 | 0 | 1 | 99 | 0 | 92 | 167 | 1787 |
| 21 | 5 | 1 | 93 | 1 | 101 | 190 | 1153 |
| 22 | 7 | 2 | 91 | 0 | 106 | 184 | 1170 |
| 23 | 6 | 1 | 93 | 0 | 108 | 182 | 1165 |
| 24 | 4 | 1 | 95 | 0 | 107 | 180 | 1172 |
| 25 | 3 | 0 | 97 | 0 | 101 | 160 | 1280 |
| 26 | 3 | 0 | 97 | 0 | 100 | 162 | 1295 |
| 27 | 4 | 0 | 96 | 0 | 102 | 165 | 1290 |
| 28 | 18 | 0 | 82 | 0 | 92 | 174 | 774 |
| 29 | 45 | 2 | 52 | 1 | 97 | 183 | 458 |
| 30 | 17 | 2 | 80 | 1 | 99 | 176 | 851 |

| | Mechanical properties of steel sheet | | | | | | |
|---|---|---|---|---|---|---|---|
| Steel sheet No. | Tensile strength (MPa) | Total elongation (%) | Fatigue strength ratio | Rmax-Rmin (mm) | Maximum camber (mm) | Ms temperature | Remarks |
| 1 | 1032 | 9 | 0.70 | 0.4 | 5 | 428 | Inventive example |
| 2 | 624 | 29 | 0.68 | 0.9 | 18 | 293 | Comparative example |
| 3 | 673 | 25 | 0.73 | 0.7 | 10 | 408 | Comparative example |
| 4 | 1007 | 9 | 0.68 | 1.2 | 34 | 431 | Comparative example |
| 5 | 1036 | 9 | 0.72 | 1.3 | 41 | 431 | Comparative example |
| 6 | 1036 | 9 | 0.73 | 1.5 | 58 | 429 | Comparative example |
| 7 | 990 | 8 | 0.73 | 1.1 | 32 | 430 | Comparative example |
| 8 | 1021 | 8 | 0.70 | 1.3 | 45 | 422 | Comparative example |
| 9 | 996 | 7 | 0.68 | 1.4 | 5 | 422 | Comparative example |
| 10 | 1038 | 12 | 0.63 | 0.3 | 6 | 422 | Comparative example |
| 11 | 1116 | 13 | 0.68 | 0.6 | 6 | 416 | Inventive example |
| 12 | 1220 | 10 | 0.68 | 0.7 | 6 | 410 | Inventive example |
| 13 | 1225 | 11 | 0.66 | 0.7 | 6 | 417 | Inventive example |
| 14 | 1217 | 10 | 0.68 | 0.7 | 13 | 417 | Inventive example |
| 15 | 1226 | 10 | 0.68 | 0.7 | 11 | 416 | Inventive example |
| 16 | 1372 | 8 | 0.68 | 0.6 | 6 | 423 | Inventive example |
| 17 | 1334 | 10 | 0.68 | 0.3 | 5 | 455 | Inventive example |
| 18 | 1515 | 8 | 0.72 | 0.6 | 8 | 423 | Inventive example |
| 19 | 1825 | 7 | 0.73 | 0.4 | 10 | 409 | Inventive example |
| 20 | 2031 | 7 | 0.72 | 0.7 | 10 | 383 | Inventive example |
| 21 | 1341 | 7 | 0.71 | 0.2 | 4 | 443 | Inventive example |
| 22 | 1360 | 7 | 0.66 | 0.4 | 4 | 442 | Inventive example |
| 23 | 1380 | 7 | 0.66 | 0.4 | 4 | 426 | Inventive example |
| 24 | 1480 | 6 | 0.66 | 0.4 | 4 | 424 | Inventive example |
| 25 | 1520 | 6 | 0.70 | 0.6 | 5 | 455 | Inventive example |

TABLE 3-continued

| | | | | | | | |
|---|---|---|---|---|---|---|---|
| 26 | 1525 | 5 | 0.71 | 0.6 | 5 | 409 | Inventive example |
| 27 | 1515 | 5 | 0.71 | 0.8 | 5 | 409 | Inventive example |
| 28 | 911 | 7 | 0.68 | 0.3 | 5 | 476 | Comparative example |
| 29 | 645 | 9 | 0.67 | 0.8 | 9 | 459 | Comparative example |
| 30 | 1001 | 9 | 0.72 | 1.4 | 9 | 297 | Comparative example |

*1: Ferrite area fraction
*2: Bainite area fraction
*3: Martensite and tempered martensite area fraction
*4: Retained austenite area fraction
*5: The ratio of the density of dislocations within the range of 0 μm to 20 μm from a surface of a steel sheet to the density of dislocations in a through-thickness central portion.
*6: The average of the top 10% of the size of cementite grains located in a depth of up to 100 μm from a surface of a steel sheet.

The invention claimed is:

1. A steel sheet comprising:

a component composition containing

C: 0.10% to 0.35%,

Si: 0.01% to 2.0%,

Mn: 0.8% to 2.35%,

P: 0.05% or less,

S: 0.005% or less,

Al: 0.005% to 0.10%, and

N: 0.0060% or less on a mass basis, the balance being Fe and inevitable impurities; and a steel structure which has a ferrite area fraction of 30% or less including 0%, a bainite area fraction of 5% or less including 0%, a martensite and tempered martensite area fraction of 70% or more including 100%, and a retained austenite area fraction of 2.0% or less including 0% and in which the ratio of the dislocation density in the range of 0 μm to 20 μm from a surface of the steel sheet to the dislocation density of a through-thickness central portion of the steel sheet is 90% to 110% and the average of the top 10% of the sizes of cementite grains located in a depth of up to 100 μm from a surface of the steel sheet is 300 nm or less, wherein a maximum camber of the steel sheet sheared to a length of 1 m in a longitudinal direction of the steel sheet is 15 mm or less.

2. The steel sheet according to claim 1, wherein the component composition further contains one or two or more of V: 0.001% to 1%, Ti: 0.001% to 0.3%, Nb: 0.001% to 0.3%, Cr: 0.001% to 1.0%, Mo: 0.001% to 1.0%, Ni: 0.01% to 1.0%, Cu: 0.01% to 1.0%, B: 0.0002% to 0.0050%, Sb: 0.001% to 0.050%, a REM: 0.0002% to 0.050%, Mg: 0.0002% to 0.050%, and Ca: 0.0002% to 0.050% on a mass basis.

3. A method for manufacturing the steel sheet according to claim 1, comprising:

a hot-rolling step of hot-rolling steel material having the component composition according to claim 1;

a cold-rolling step of pickling and cold-rolling a steel sheet after the hot-rolling step; and an annealing step of heating the steel sheet after the cold-rolling step to 820° C. or higher in an atmosphere with a dew point of −25° C. or lower, starting water quenching at 700° C. or higher to water-cool the steel sheet to 100° C. or lower, and then reheating the steel sheet at 100° C. to 300° C., wherein the steel sheet in water cooling for the water quenching in the annealing step is pressed with two rolls placed to hold the steel sheet from front and back surfaces of the steel sheet in a region that the surface temperature of the steel sheet is not lower than (Ms−250° C.) that is a temperature 250° C. lower than the Ms point nor higher than (Ms+150° C.) that is a temperature 150° C. higher than the Ms point, the pressing being performed under conditions that an inter-roll distance between the two rolls is 20 mm to 250 mm and a pressing force is 196 N or more.

4. A method for manufacturing the steel sheet according to claim 2, comprising:

a hot-rolling step of hot-rolling steel material having the component composition according to claim 2;

a cold-rolling step of pickling and cold-rolling a steel sheet after the hot-rolling step; and an annealing step of heating the steel sheet after the cold-rolling step to 820° C. or higher in an atmosphere with a dew point of −25° C. or lower, starting water quenching at 700° C. or higher to water-cool the steel sheet to 100° C. or lower, and then reheating the steel sheet at 100° C. to 300° C., wherein the steel sheet in water cooling for the water quenching in the annealing step is pressed with two rolls placed to hold the steel sheet from front and back surfaces of the steel sheet in a region that the surface temperature of the steel sheet is not lower than (Ms−250° C.) that is a temperature 250° C. lower than the Ms point nor higher than (Ms+150° C.) that is a temperature 150° C. higher than the Ms point, the pressing being performed under conditions that an inter-roll distance between the two rolls is 20 mm to 250 mm and a pressing force is 196 N or more.

* * * * *